United States Patent [19]

Mizuguchi

[11] Patent Number: 4,474,221

[45] Date of Patent: Oct. 2, 1984

[54] POSITIVE DOBBY MACHINE

[75] Inventor: Hiroyuki Mizuguchi, Aichi, Japan

[73] Assignee: Yamada Dobby Co., Ltd., Bisai, Japan

[21] Appl. No.: 418,740

[22] Filed: Sep. 16, 1982

[51] Int. Cl.[3] ..... D03C 1/06

[52] U.S. Cl. ..... 139/71; 139/68

[58] Field of Search ..... 139/66–74

[56] References Cited

U.S. PATENT DOCUMENTS

| | | | |
|---|---|---|---|
| 3,665,973 | 5/1972 | Reisdorf | 139/71 |
| 4,305,432 | 12/1981 | Schwarz . | |
| 4,386,631 | 6/1983 | Mizoguchi | 139/71 X |

FOREIGN PATENT DOCUMENTS

| | | | |
|---|---|---|---|
| 71943 | 2/1983 | European Pat. Off. | 139/71 |
| 1535219 | 10/1969 | Fed. Rep. of Germany | 139/71 |
| 47-5464 | 2/1972 | Japan | 139/66 R |

*Primary Examiner*—James Kee Chi

*Attorney, Agent, or Firm*—Armstrong, Nikaido, Marmelstein & Kubovcik

[57] ABSTRACT

A positive dobby machine characterized in that return knives (16*a*), (16*b*) move in parallel and have pressure receiving planes (18*a*), (18*b*) perpendicular to the moving direction, first pressure receiving planes (7*a*), (7*b*) which can be contacted in surface contact state with the pressure receiving planes (18*a*), (18*b*) of return knives (16*a*), (16*b*) are formed on hooks (6*a*), (6*b*) pivotally attached respectively to upper and lower ends of a vertical lever (5), and the first pressure receiving planes (7*a*), (7*b*) of the hooks (6*a*), (6*b*) is pushed in surface contact state by the pressure receiving planes (18*a*), (18*b*) of the return knives (16*a*), (16*b*) thereby the vertical lever (5) is driven.

4 Claims, 1 Drawing Figure

POSITIVE DOBBY MACHINE

BACKGROUND OF THE INVENTION (1) Field of the Invention

The present invention relates to positive dobby machines constituted to drive heald frames positively in both upward and downward directions, and more specifically to a positive dobby machine where mechanism in a vertical lever, upper and lower hooks pivotally connected respectively to upper and lower ends of the vertical lever, and upper and lower return knives acting to push back both ends of the vertical lever.

(2) Description of the Prior Art

In positive dobby machine in prior art, a command device constituted to generate command corresponding to fabric pattern acts to rotate upper and lower hooks pivotally connected respectively to upper and lower ends of a vertical lever. Therefore upper and lower return knives opposed respectively to upper and lower ends of the vertical lever are contacted with both ends of the vertical lever directly so as to transmit movement. If upper and lower return knives were constituted to push the vertical lever through upper and lower hooks, the pushing force would produce revolution resistance in the upper and lower hooks and rotation of both hooks according to the command device would be difficult.

Since the revolution center of the vertical lever and upper and lower return knives cannot coincide with each other, surface contact state of the vertical lever with the return knife cannot be held throughout whole stroke of transmission. Therefore, partial cylindrical surfaces are usually formed on upper and lower ends of the vertical lever, and pressure receiving surfaces of upper and lower knives opposed to respective cylindrical surfaces are formed in flat planes, so that the cylindrical surface and the flat plane are contacted with each other in line contact state. In such constitution, pressure per unit area between the vertical lever and the return knife becomes very large. Moreover sliding phenomenon between contact portions because of non-coincidance of the revolution center increases abrasion of the contact portions. High-speed operation of positive dobby machines therefore has been obstructed.

SUMMARY OF THE INVENTION

This invention is characterized in constitution of an apparatus that upper and lower return knives are contacted in surface contact state with upper and lower hooks and push them, which hooks are pivotally attached to upper and lower ends of a vertical lever, a command device acts on upper and lower knife hooks which can be engaged with the upper and lower hooks respectively, upper and lower knife shafts which support the upper and lower knife hooks respectively are moved in parallel and integral with the upper and lower return knives, and upper and lower hook stoppers which are engaged with the upper and lower hooks respectively are moved by the upper and lower knife hooks.

An object of this invention is to provide a positive dobby machine in which movement of upper and lower return knives is transmitted to upper and lower ends of a vertical lever through surface contact means thereby abrasion in transmission portion is reduced.

Another object of this invention is to provide a positive dobby machine which can be driven at high speed.

Above mentioned and other objects and features of this invention will be apparent from the following description referring to the accompanying drawings. However, the drawings are for explanation only and not for limiting the seope of this invention.

BRIEF DESCRIPTION OF THE DRAWINGS

The drawings show preferable embodiments of this invention.

The FIGURE is a schematic sectional view of a positive dobby machine.

DESCRIPTION OF THE PREFERRED EMBODIMENT

Figure 1:
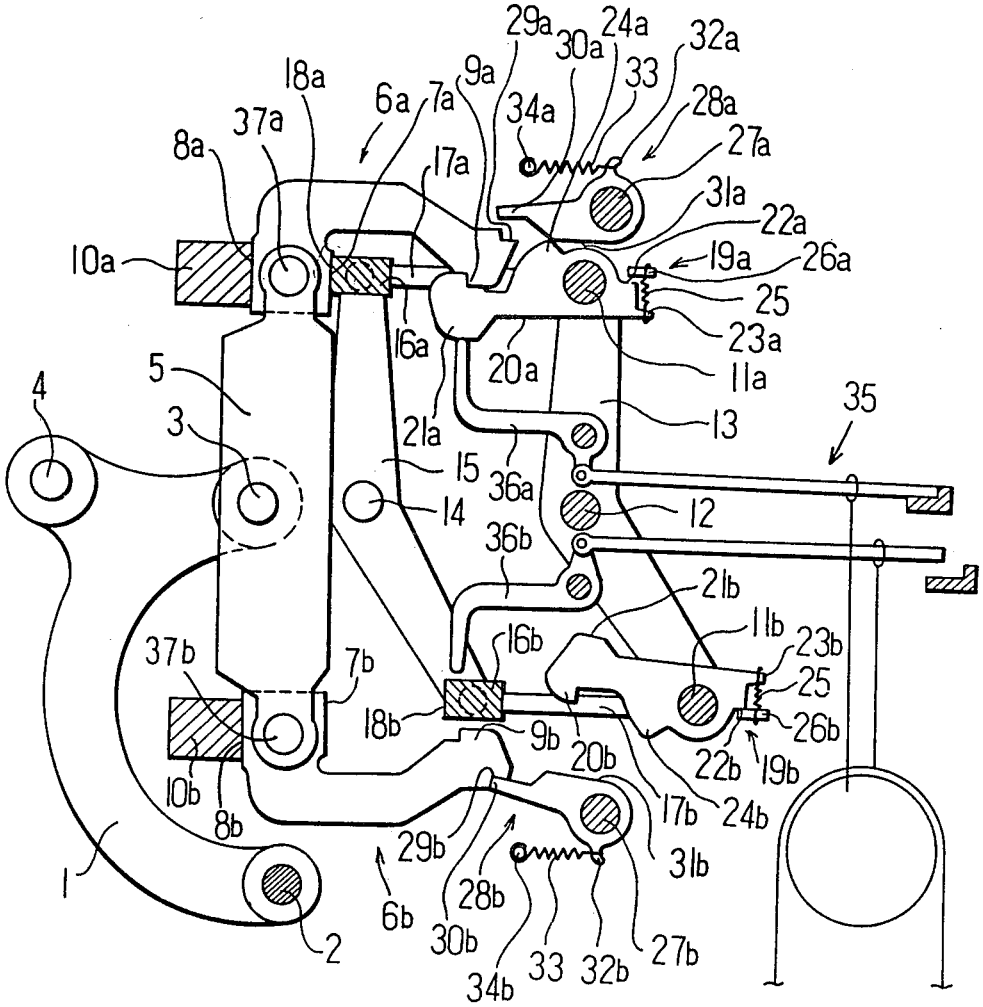

A preferred embodiment of the present invention will now be described referring to the FIGURE. A stationary shaft 2 has both longitudinal ends fixed to a machine frame (not shown) A plurality of jack levers 1 are arranged in longitudinal direction on the stationary shaft 2 and rotatably supported, the number of the jack levers 1 being the same as that of heald frames (not shown). Each jack lever 1 is provided with a pin 4 to which is pivotally connected a connecting rod (not shown) in similar manner to conventional positive dobby machine. The connecting rod is connected to a shedding lever (not shown) which, in turn, is connected to heald frame (not shown) through transmission means. The jack lever 1 is provided with another pin 3 to which a vertical lever 5 is pivotally connected. The vertical lever 5 is formed in vertical symmetry with respect to the pin 3 and has both vertical ends to which an upper hook **6*a* and a lower hook 6*b* are connected respectively through pins 37*a* and 37*b*. The upper hook 6*a* and the lower hook 6*b* are formed in vertical symmetry. First pressure receiving planes 7*a*, 7*b* and second pressure receiving planes 8*a*, 8*b* are parallel to each other and formed at both lateral sides of the pins 37*a* and 37*b*. The upper hook 6*a* and lower hook 6*b* are provided at respective top ends with hooks 9*a*, 9*b*and notch portions 29*a*, 29*b***.

Each of upper stoppers **10*a* and lower stoppers 10*b* has both longitudinal ends connected to the machine frame. When the vertical lever 5 and second pressure receiving planes 8*a*, 8*b* of the upper and lower hooks 6*a*, 6*b* are all in the vertical direction, the upper stopper 10*a* contacts with the second pressure receiving plane 8*a* of the upper hook 6*a* in surface contact state and also the lower stopper 10*b* contacts with the second pressure receiving plane 8*b* of the lower hook 6*b* in similar manner. As clearly seen from the FIGURE, above mentioned state occurs when the jack lever 1 is rotated most in counterclockwise direction. In this attitude, a driving shaft 12 being as high as the pin 3 has both longitudinal ends rotatably supported on the machine frame and is moved in reciprocal rotating motion by means of driving mechanism (not shown). On forward and rearward sides of the driving shaft 12 are fixed two driving levers 13 each bent in symmetric form with respect to the driving shaft 12. Two driving levers 13 respectively have both vertical ends to support an upper knife shaft 11*a* and a lower knife shaft 11*b* rotatably. A driven lever 15 has the same configuration as the driving lever 13 and is pivotally mounted on the machine frame by a pin 14 being as high as the driving shaft 12. Two driven levers 15 are opposed respectively to two driving levers 13. Both longitudinal ends of an upper return knife 16*a*** are pivotally connected to upper ends of two forward and rearward driven levers 15 respectively, and in similar manner both longitudinal ends of a lower return knife 16*b* are pivotally connected to lower ends of two driven levers 15 respectively. An upper connecting member 17*a* and a lower connecting member 17*b* are integrally connected respectively with the right side of both longitudinal ends of the upper and lower return knives 16*a*, 16*b*. The right ends of upper and lower connecting members 17*a*, 17*b* are integrally connected respectively with the upper and lower knife shafts 11*a*, 11*b*. Distance from the axial center of upper and lower knife shafts 11*a*, 11*b* to the axial center of upper and lower return knives 16*a*, 16*b* opposed thereto is equal to distance between the axial centers of the driving shaft 12 and the pin 14. Parallelogram link mechanism is therefore constituted by the driving lever 13, the driven lever 15 and the upper and lower return knives having the upper and lower connecting members 17*a*, 17*b*, so that the upper return knife 16*a*, the upper connecting member 17*a*, and the upper knife 11*a* are integrally moved in parallel, and in similar manner the lower return knife 16*b*, the lower connecting member 17*b* and the lower knife shaft 11*b* are moved in parallel. Pressure receiving planes 18*a*, 18*b* in the vertical direction are formed respectively on leftside of the upper and lower return knives 16*a*, 16*b*.

When counterclockwise rotation of the driving lever 13 is stopped, the upper hook 6*a* is interposed between the pressure receiving plane 18 of upper return knife and the upper stopper 10*a*, and the pressure receiving plane 18*a* of upper return knife is contacted with the first pressure receiving plane 7*a* of the upper hook 6*a* in surface contact state. In similar manner, when clockwise rotation of the driving lever 13 is stopped, the lower hook 6*b* is interposed between the lower return knife 16*b* and the lower stopper 10*b*, and the pressure receiving plane 18*b* of lower return knife is contacted with the first pressure receiving plane 7*b* of the lower hook 6*b* in surface contact state.

On the upper knife shaft 11*a* is pivotally mounted an upper knife hook 19*a* in opposition to the upper hook 6*a*. The upper knife hook 19*a* comprises an upward hook 20*a* engageable with the hook portion 9*a* of the upper hook 6*a* at stopping state of counterclockwise rotation of the driving lever 13, a command receiving portion 21*a* below the hook portion 20*a*, a stopper surface 22*a* formed at right side of the upper knife shaft 11*a*, a spring hook 23*a* below the stopper surface 22*a*, and a projection 24*a* formed at upper left-side of the upper knife shaft 11*a*. Other end of the spring 25 is hung to the spring hook 23*a* and connected with the upper stay 26*a*. The upper stay 26*a* has both longitudinal ends fixed to two upper connecting members 17*a* respectively. The upper knife hook 19*a* is urged counterclockwise. If a hereinafter described upper command lever 36*a* raises the command receiving portion 21*a*, the hook portion 9*a*; if the upper command lever 36*a* does not act, the stopper surface 22*a* is contacted with the upper stay 26*a* and in this attitude the hook 20*a* is not engaged with the hook portion 9*a*.

An upper stopper shaft 27*a* has both longitudinal ends fixed on the machine frame. A plurality of upper stoppers 28*a*, each being opposed to the upper hook 6*a* and the upper knife hook 19*a*, are pivotally mounted on the upper stopper shaft 27*a*. If a pawl 30*a* at the top end of the upper hook stopper 28*a* is engaged with a notch 29*a* of the upper hook 6*a*, the second pressure receiving plane 8*a* of the upper hook 6*a* is contacted with the upper stopper 10*a* in surface contact state thereby upper end of the vertical lever 5 is held at the left end position. A pressure receiving plane 31*a* is formed at lower surface of the upper hook stopper 28*a*. If the pressure receiving plane 31*a* is raised by a projection 24*a* of the upper knife hook 19*a* rotating clockwise engagement of the pawl 30*a* with the notch 29*a* is released. A coil spring 33 is stretched between a spring hook 32*a* of the upper hook stopper 28*a* and an upper stay rod 34*a* having both longitudinal ends fized on the machine frame, thereby the upper hook stopper 28*a* is urged in counterclockwise direction.

A lower knife hook 19*a*, a lower stay 26*b*, a lower stopper shaft 27*b*, a lower hook stopper 28*b* and the like are formed in vertical symmetry to the upper hook 19*a*, the upper stay 26*a*, the upper stopper shaft 27*a*, the upper hook stopper 28*a* and the like.

A command device 35 is a known device where an endless card with perforation corresponding to fabric pattern is transferred using a drum, the perforation is detected by a vertical needle, the needle controls height in right end of a horizontal rod, the right end of horizontal rod is pushed by a knife reciprocating in horizontal direction, and an upper command lever 36*a* and a lower command lever 36*b* connected to the left end of horizontal rod are operated. While the driving lever 113 finishes to rotate counterclockwise and begins to rotate clockwise, the upper command lever 36*a* raises the upper knife hook 19*a* to engage the hook portion 20*a* with the hook portion 9*a*, and the knife 19*a* disengages the upper hook stopper 28*a* from the upper hook 6*a*. While the driving lever 13 rotates clockwise, the lower command lever 36*b* similarly engages the lower hook 6*b* with the lower knife hook 19*b*, and the lower knife hook 19*b* disengages the lower hook stopper 28*b* from the lower hook 6*b*.

THE FIGURE shows above mentioned attitude where the vertical lever is in the vertical direction, the jack lever 1 stop to rotate counterclockwise, the driving lever 13 and the driven lever 15 also stop to rotate counterclockwise, the upper command lever 36*a* of the command device 35 engages the upper knife hook 19*a* with the upper hook 6*a*, the upper hook stopper 28*a* is disengaged from the upper hook 6*a*, and the lower hook stopper 28*b* is engaged with the lower hook 6*b*. This state corresponds to attitude of the heald in downward posirion. If the driving lever 13 rotates clockwise, the upper knife hook 19*a* pulls the upper hook 6*a* rightwards, the vertical lever 5 rotates clockwise about the pin 37*b* and the jack lever 1 also rotates clockwise thereby the heald frame is moved upwards. When the driving lever 13 stops to rotate clockwise, the heald frame comes to the top dead center. In this state, the driven lever 15 rotes in similar manner to the driving lever 13. If the driving lever 13 and the driven lever 15 begin to rotate counterclockwise, since the upper command lever 36*a* does not wupport the upper knife hook 19*a* then, the upper knife hook 19*a* is disengaged from the upper hook 6*a* and rotates counterclockwise until the stopper surface 22*a* thereof is contacted with the upper stay 26*a*. Then the upper return knife 16*a* pushes the upper hook 16*a* leftwards, the vertical lever 5 rotates counterclockwise about the pin 37*b*, and the jack lever 1 also rotates counterclockwise, thereby the heald frame is moved downwards. When the driving lever 13 and the driven lever 15 stop to rotate counterclockwise, the heald frame comes to the bottom dead center. Although above description concerns operation of the upper knife hook 19*a* by the upper command lever 36*a* of the command device 35, when the lower knife hook 19*b* is operated by the lower command lever 36*b*, the lower knife hook 19*b* is engaged with the lower hook 6*b* before the beginning of counterclockwise rotation of the driving lever 13 and the driven lever 15, and the pawl 38*a* of the upper hook stopper 28*a* is engaged with the notch 29*a* of the upper hook 6*a*. If the driving lever 13 rotates counterclockwise, the vertical lever 5 rotates counterclockwise about the pin 37*a* and the jack lever 1 rotates clockwise, thereby the heald frame is moved upwards. Subsequent operation is performed in similar manner to the case of operation of the upper knife hook 19*a* as above described. Both two cases as above described concern the heald frame moved up and down. If neither the upper command lever 36*a* nor the lower command lever 36*b* acts, the vertical lever 5 keeps attitude as shown and the heald frame is still held in the bottom dead center. In order to hold the heald frame in the top dead center continuously, the pper command lever, for example, is operated, and when the driving lever 13 finishes to rotate clockwise and the heald frame comes to the top dead center as above described, the lower command lever 36*b* is operated. If the driving lever 13 begins to rotate counterclockwise, the upper hook 6*a* is moved leftwards and the lower hook 6*b* is moved rightwards. Since stroke of both hooks 6*a*, 6*b* is equal, the vertical lever 5 only rocks about the pin 3 and the jack lever 1 does not rotate, thereby the heald frame is held in the top dead center.

If the heald frame is raised in above mentioned operations, the vertical lever 5 rotates counterclockwise (or clockwise) about the pin 37*a* (or pin 37*b*) and reaction force in the fulcrum is received by surface contact of the upper stopper 10*a* (or lower stopper 10*b*) with the second pressure receiving plane 8*a* of the upper hook 6*a* (or the second pressure receiving plane 8*b* of the lower hook 6*b*). Reaction force during downward motion of the heald frame is received by surface contact of the first pressure receiving plane 7*a* of the upper hook 6*a* (or the first pressure receiving plane 7*b* of the lower hook 6*b*) with the pressure receiving plane 18*a* of the upper return knife 16*a* (or the pressure receiving plane 18*b* of the lower return knife 16*b*). Further, reaction force during continuous holding of the heald frame in the top dead center is received by surface contact of the first pressure receiving plane 7*a* of the upper hook 6*a* with the pressure receiving surface 18*a* of the upper return knife 16*a* or by surface contact of the first pressure receiving plane 7*b* of the lower hook 6*b* with the pressure receiving plane 18*b* of the lower return knife 16*b*. Accordingly, although above mentioned portions in surface contact state are subjected to sliding action because of difference of revolution center positions of members relating to contact planes or fixed state of one plane, the surface contact state causes little abrasion.

What is claimed is:

1. A positive dobby machine, comprising a jack lever for moving a heald frame, a vertical lever with a center portion pivotally connected to said jack lever, hooks pivotally connected respectively, to the upper and lower ends of the vertical lever, return knives for moving the ends of said jack lever in an opposite direction to the hook moving direction, hook stoppers engaged with the hooks, stoppers for supporting the upper and lower ends of the vertical lever, a drive lever opposed to the vertical lever, a driving lever coupled to the vertical lever on opposite sides with respect to the driven lever, wherein the axial center of the driving lever, the axial center of the driven lever and the center portion of the vertical lever are arranged approximately in a line, knife shafts coupled respectively to the upper and lower ends of the driving lever, the return knives being supported respectively on the upper and lower ends of the driven lever, connecting members coupled to respective return knives and connected to the knife shaft, wherein a parallelogram link mechanism is formed by the driving lever, the driven lever and the return knives having the connecting members such that the return knives are moved in parallel, and wherein each return knife has a planar pressure receiving surface on the side opposed to the vertical lever, the planar pressure receiving surface being perpendicular to the direction of the line between axial center of the driving lever and axial center of the driven lever and the hook has a first planar pressure receiving surface opposed to the planar pressure receiving surface of the return knife which contacts the pressure receiving surface in a surface contact state.

2. A positive dobby machine according to claim 1, wherein a knife hook is pivotally mounted on the knife shaft, the knife hook being engaged with the hook and operated by a command device.

3. A positive dobby machine according to claim 2, wherein the hook stopper is interlocked with the knife hook.

4. A positive dobby machine according to claim 1, wherein the hook has a second planar pressure receiving surface which is opposed to and in parallel to the first prssure receiving surface, and the stopper has a planar pressure receiving surface which contacts the second planar pressure receiving surface in a surface contact state.

* * * * *